United States Patent [19]

Magherini

[11] 4,034,448

[45] July 12, 1977

[54] METHOD FOR MASS-PRODUCING BULB SOCKETS FOR MINIATURE LAMPS IN SERIES ON A SINGLE CABLE FLEXIBLE ELECTRIC CORD

[76] Inventor: Dino Magherini, Via Osservatorio 36, Florence, Italy

[21] Appl. No.: 727,522

[22] Filed: Sept. 28, 1976

Related U.S. Application Data

[63] Continuation of Ser. No. 531,818, Dec. 11, 1974, abandoned.

[30] Foreign Application Priority Data

Dec. 12, 1973 Italy ..... 9718/73

[51] Int. Cl.[2] ..... H01J 9/18

[52] U.S. Cl. ..... 29/25.16

[58] Field of Search ..... 29/203 R, 25.13, 25.15, 29/25.16; 425/110, 121; 29/628, 33 M; 339/218 L, 119 L; 264/272

[56] References Cited

U.S. PATENT DOCUMENTS 3,939,541 2/1976 Magherini ..... 29/203 R

*Primary Examiner*—Richard B. Lazarus

[57] ABSTRACT

A method for mass producing bulb sockets for plug-in miniature lights directly on an electric cable comprising successively passing a single line flexible cable through a plurality of stages of operation inclusive of a socket molding station where sockets are heat molded on the cable, and effecting the operation at the stages simultaneously to continuously produce a completed cable.

5 Claims, 7 Drawing Figures

METHOD FOR MASS-PRODUCING BULB SOCKETS FOR MINIATURE LAMPS IN SERIES ON A SINGLE CABLE FLEXIBLE ELECTRIC CORD

CROSS-RELATED APPLICATION

This application is a continuation of copending application 531,818 filed Dec. 11, 1974 and now abandoned.

FIELD OF THE INVENTION

The invention relates to methods of mass producing bulb sockets for plug-in miniature lights directly on an electric cord.

BACKGROUND AND PRIOR ART

It is known to use miniature lamps with or without plug bases for decorating Christmas trees and for other purposes. These require suitable sockets on the electric wire. A process is also known for manufacturing, continuously and automatically, sockets for plug-in microlamps on a flexible two-wire cable as an electric line cord insures feed continuity of the cord throughout the working phases of preparation whereafter injection molding of a socket is effected for each completed cycle. Since the working cycle comprises several phases and while the various mechanical operations take place very quickly, the socket-molding phase involves more time to enable the molded object to cool. This means that the time involved in completing the cycle is conditioned upon the time involved in the socket-molding phase.

SUMMARY OF THE INVENTION

An object of this invention is to provide improvements in the above-mentioned process and to produce a notably better product. The invention is based essentially on the concept of carrying out the various operations of cable preparation and socket molding simultaneously at various points of the cable with the expedient of arranging the different cable portions that are taken in and unite the sockets two by two according to a comb-like string or series of objects. For this purpose a double-wire cable is no longer used and only a single-pole cable is required. The invention contemplates arranging the winding cable with its various intervals on a cylinder, rotating the cylinder on its horizontal axis, with an intermittent forward motion that corresponds to the speed of movement of the string; distributing working stations for the different operations, fixed and independent of the cable support, along one or both base circumferences of said cylinder, i.e., in front of the loops or bends of the string; placing a mold for the molding of the sockets in front of each bend of the string and integral with the cable support, so that each mold is used but once for every each working cycle, thereby enabling the mold to remain closed after injection of the thermosplastic material for the time it takes the molded object to cool.

This invention will next be described in greater detail by referring to the attached drawings which schematically show the series of working phases which make up the operation cycle.

DETAILED DESCRIPTION

Figure 1:
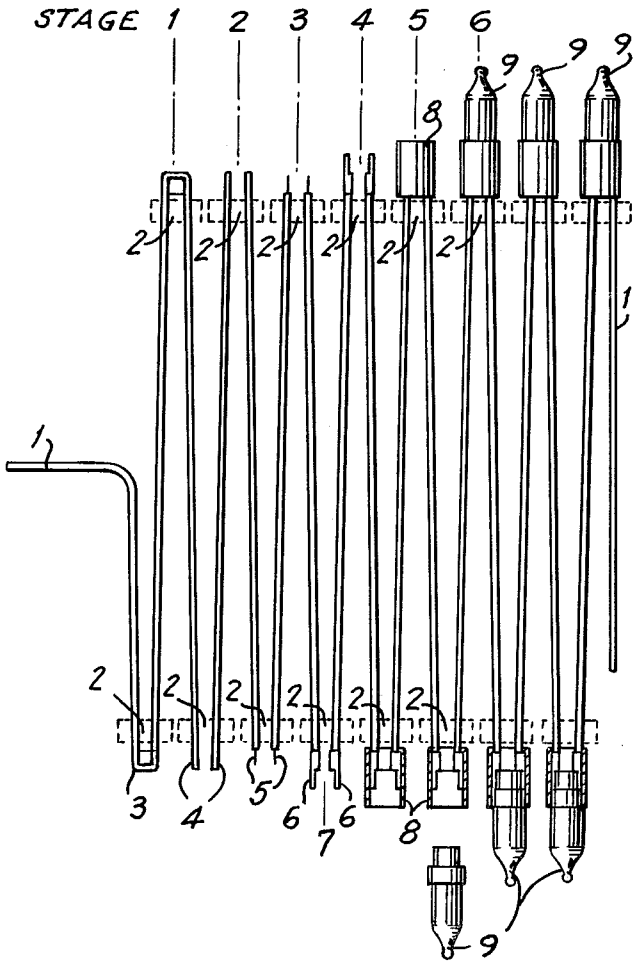
FIG. 1 is a diagrammatic view showing the operation of the method of the invention.

FIG. 1 shows the arrangement of a portion of the electric wire according to a comb-like string, on which the operations are carried out at six different points on both sides of the string. Stage 1 represents the first phase of the locking of the wire. Stage 2 represents the second phase of cutting the wire at each end of each bend or turn of the string. Stage 3 represents the third phase of baring the wire at a portion of the end of each bend of the string. Stage 4 represents the fourth phase of applying a blade-like contact on each portion of the barred wire, the two contacts provided for the same socket being opposite each other and parallel. Stage 5 represents the fifth phase of thermoplastic injection molding of a socket in correspondence with each pair of blade-like contacts. Stage 6 represents the sixth phase of inserting a plug-in microlamp in each of the molded sockets.

Figure 2:
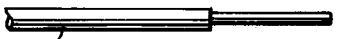
FIG. 2 is a detail of the wire in one stage of operation of the method.
Figure 3C:
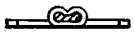
FIG. 3*c* is a section taken along line 3*c*—3*c* in FIG. 3*b*.
Figure 3B:
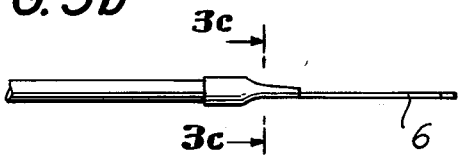
FIG. 3*b* is an elevation view of the detail of FIG. 3*a*.
Figure 3A:
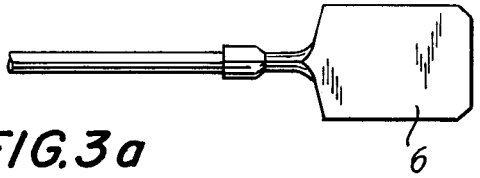
FIG. 3*a* is a plan view of a further detail in another stage of operation of the method.
Figure 4B:
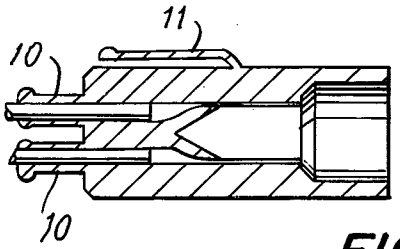
FIG. 4*b* is a sectional view taken on line 4*b*—4*b* in FIG. 4*a*.
Figure 4A:
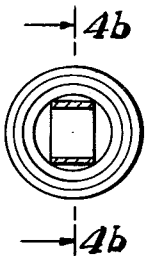
FIG. 4*a* is a sectional view taken on line 4*a*—4*a* in FIG. 4*b*.

FIG. 2 is a plan view of a fragment of wire showing a bared end portion and FIGS. 3*a*–3*b* represent plan and side views of a blade-like contact applied to the bared end of said wire fragment, FIG. 3*c* being a section through the base of the applied contact. FIG. 4 is an end sectional view of a socket and FIG. 4*b* is a longitudinal section through the socket.

According to the process of this invention, reduced to its essential features and with reference to the attached drawings there are effected the steps comprising causing intermittent forward movement of flexible single-pole cable 1, properly tensioned and having a purposely serpentine or comb-like string configuration and carrying out all phases of the working cycle, each at one loop or bend of the string at one or both ends of the string so that the operations are effected simultaneously on this cable at constant time intervals.

These phases in progressive order of movement of the cable include the first phase during which the cable is locked in correspondence at each bend 2; the second phase during which a portion of a cable forming the central part 3 of each bend of the string is cut; the third phase during which the insulation at 4 is removed from the cable at the cut-off ends of each bend for baring the wire 5; the fourth phase during which two blades 6 of electroconductive material are clinched on symmetrically and opposite one another with respect to the plane of symmetry 7 of each bend; the fifth phase during which a socket 8 is injection-molded of thermoplastic material onto the wire around a pair of blades; and the sixth phase during which a miniature lamp 9 is placed into the now molded socket 8. When the cable string has gone through the entire course, passing the front of the various working stations, the manufactured article is finished.

It is to be understood that the cable 1 is periodically fed or drawn from a cylinder (not shown) into the support (shown in dotted outline), by a conventional looper (not shown) such that the cable is wound with the alternating upper and lower loops or bends in the supports where the cable is clamped. The support undergoes stepwise movement in synchronization with the cable feed to carry the cable through the successive stages of operation. FIG. 1 shows two loops or bends formed in the cable at the top and bottom and it is possible to provide a plurality of pairs of top and bottom bends in which case a corresponding plurality of operations would be carried out at each state of operation.

It is to be further appreciated that despite the separation of adjacent wires at the bends during cutting, these are ultimately re-united by the molding of the sockets to provide continuity of the finished string.

As regards the product obtained by the process, this comprises an electric line of decorative lights in series with any number of miniature lamps arranged in series. Additionally, the side surface of the sockets is totally or at least partially knurled to facilitate handling during application. Finally, the sockets 8 can be equipped with two flexible and elastic stalk-like pieces 10 coming out of the bottom of the base and/or with a hook 11 attached to the side surface to enable the sockets to be clipped onto whatever is to be decorated.

In practice, the details of execution can vary as regards shape, sizes and arrangement of the elements, and nature of the materials used, remaining always within the purview of the original concept and therefore within the limits defined by the appended claims.

What is claimed is:

1. A method for mass producing bulb sockets for plug-in miniature lights directly on a single-line, flexible electric cable having alternating turns, said method comprising the operational steps of: successively and intermittently passing the cable through a plurality of operational stages including cutting the cable at the turns in a first of the operational stages, thereby leaving two adjacent unconnected ends at each turn, baring the cable at the adjacent ends in a second operational stage, clinching two blade-like contact members on the bared ends in a third operational stage, injection molding plug-in miniature-lamp type sockets on the wire around the contact members in a fourth operational stage, and inserting a plug-in miniature lamp in ech of the sockets in a fifth operational stage, the injection molding of the sockets on the cable being effected in movable molds, effecting the operational steps in the stages simultaneously, thereby continuously producing a completed cable, placing a mold for said injection molding step in front of discrete portions of the cable, using each mold once for each intermittent operation of the operational stages, thereby enabling the molds to remain closed after said molding step for the time it takes the sockets to cool.

2. The method as claimed in claim 1 further comprising the step of winding the cable in a support, and advancing the latter stepwise through the operational stages.

3. The method as claimed in claim 2 further comprising the step of unwinding the cable from a supply thereof into the support, in synchronism with the step of advancing the latter in a stepwise manner.

4. The method as claimed in claim 2 wherein said winding step is performed in loop formation, the alternating turns of the cable being at the top and the bottom.

5. The method as claimed in claim 4 further comprising the step of holding the wire in the support adjacent each alternating turn.

* * * * *